US007886677B2

(12) United States Patent
Strom

(10) Patent No.: US 7,886,677 B2
(45) Date of Patent: Feb. 15, 2011

(54) MULTI-PURPOSE STORAGE RACK AND FISHING TROLLER FOR A PERSONAL WATERCRAFT

(76) Inventor: Kraig Strom, 2945 Stonewall Dr., Corona, CA (US) 92882

( * ) Notice: Subject to any disclaimer, the term of this patent is extended or adjusted under 35 U.S.C. 154(b) by 197 days.

(21) Appl. No.: 12/236,191

(22) Filed: Sep. 23, 2008

(65) Prior Publication Data

US 2009/0020066 A1 Jan. 22, 2009

Related U.S. Application Data

(63) Continuation-in-part of application No. 11/515,451, filed on Sep. 5, 2006, now abandoned, which is a continuation-in-part of application No. 11/044,107, filed on Jan. 27, 2005, now Pat. No. 7,124,704.

(51) Int. Cl.
*B63B 17/00* (2006.01)

(52) U.S. Cl. ..... 114/55.5; 114/364

(58) Field of Classification Search ..... 114/364, 114/55.5

See application file for complete search history.

(56) References Cited

U.S. PATENT DOCUMENTS 2,794,191 A * 6/1957 Gaskouitz ..... 114/364
3,032,783 A * 5/1962 Swanson, Jr. ..... 114/364
4,014,586 A 3/1977 Swofford
4,724,791 A * 2/1988 McSorley ..... 114/343
5,096,107 A 3/1992 VanSon
6,189,753 B1 2/2001 Kalhok et al.
7,124,704 B1 10/2006 Strom
7,273,221 B2 9/2007 Ockenden
2002/0045417 A1 4/2002 Homer, Sr.
2002/0088661 A1 7/2002 Gagnon et al.
2003/0066853 A1 4/2003 Herbert
2003/0226492 A1 * 12/2003 Hoyt ..... 114/364

* cited by examiner

*Primary Examiner*—Stephen Avila
(74) *Attorney, Agent, or Firm*—Kirk A. Buhler; Buhler & Associates

(57) ABSTRACT

The present invention is for an apparatus for use on a personal water craft having a hull, a deck disposed on the hull, a hood movably connected to the forward portion of the deck, an engine position within the hull, a seat mounted atop the deck for accommodating at least one rider and comprising: at least one multi-purpose rack is clamped to the personal water craft; wherein at least a portion of the multi-purpose rack is disposed forward of the seat; wherein at least a portion of the multi-purpose rack extends outwardly from the hood to a peripheral edge of the water craft; and wherein the multi-purpose rack has a surface for carrying one or more items. Wherein the multipurpose rack can hold and store items such as fishing equipment, camping equipment, water skies, wake boards, scuba diving equipment, and inner-tubes on the personal water craft.

8 Claims, 4 Drawing Sheets

MULTI-PURPOSE STORAGE RACK AND FISHING TROLLER FOR A PERSONAL WATERCRAFT

CROSS REFERENCE TO RELATED APPLICATION

This application claims priority to application Ser. No. 11/515,451 filed on Sep. 5, 2006 (now abandoned) which claims priority to Ser. No. 11/044,107 filed on Jan. 27, 2005 now U.S. Pat. No. 7,124,704 issued on Oct. 24, 2006 the entire contents of which are hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The field of the invention relates to personal watercrafts. Specifically, a multi-purpose storage rack and fishing troller for personal watercrafts.

Description of Related Art including information disclosed under 37 CFR 1.97 and 1.98:

An enormous problem that personal water crafts (PWC) sold under the names as "Jet Ski", "Wave Runner", "Seadoo", "AquTrax" and others have always encountered is a lack of storage space. Personal watercrafts generally only provide storage space in the bow and glove box of the personal watercraft. Since personal water crafts are so small, they do not have large storage space for storing items such as fishing equipment, camping equipment, hunting equipment, water skies, wake boards, scuba diving equipment, inner-tubes and other such articles or items.

Carriers or racks have been employed on small vehicles for lashing of goods to the vehicle for transportation. Such racks often include a frame structure of tubular material fixed to the frame of the vehicle. Such racks are located behind the rider extending across the upper rear portion of the vehicle.

Although carriers or racks are commonly utilized with motorcycles, A1'Vs, farm vehicles, fishing boats and hunting boats, such racks have not been utilized for use with personal water crafts. Additionally, carriers or racks are often attached to the rear of the vehicle. However, attaching a rack to the rear of the personal watercraft could be dangerous, as riders often fall off to the side and back of the watercraft.

The personal water crafts that we use and see today have dramatically evolved from the single cylinder engine and the single person water crafts of the of the 1960's. The personal watercrafts of today provide more stability, maneuverability, versatility, control, acceleration, torque and power. In fact, today's personal watercrafts can accommodate as many as four people.

Early personal watercrafts were equipped with a single cylinder engine, which reached speeds of approximately 25 to 30 mph. Those watercrafts were only used for recreational riding activities. The watercrafts were not designed with enough acceleration, torque and horsepower to pull water skiers, wake boarders, and inner tubers. In comparison, today's personal watercrafts can reach speeds of over 60 miles per hour with the power of more than 215 hp.

The original personal watercrafts had hulls that were flat, which caused the watercraft to turn "wide" encompassing a large surface area. Conversely, today's personal watercrafts utilize a hull that is v-shaped which allows the watercraft to make "tighter" and narrower turns in the water. Additionally, some personal watercrafts have also utilized two hulls, which create more stability in the vehicle. As a result of this added stability, personal watercrafts of today can be utilized by more than one person at a time.

The improvements in the design of the hull as well as other areas of the personal watercrafts have increased their maneuverability and stability, allowing today's personal watercrafts to be utilized in a variety of activities.

Another feature that has helped increase the versatility of personal watercrafts is that they are equipped with forward/neutral/reverse, capabilities which allow users more control in the operation of the watercraft. This option similarly contributes to the versatility and function of the present day watercrafts.

In comparison to any boat, personal watercrafts are smaller in size. As such, they afford the user a number of additional functions not available in a boat. The watercraft can maneuver in tight corridors, go up or down small rivers or streams, and even traverse swamps. Personal watercrafts also allow access to shallow areas of water.

Only recently were personal water crafts designed with the added acceleration, torque and horse power to pull the weight of water skiers, wake boarders, and inner tubers alike. As such, a user can now use the personal watercraft to engage in activities that were once impossible.

Although, the design of the personal watercraft evolved to allow for more power and function, it has not made any adjustments to increase storage space. Skiers often have to physically hold their water skies or their wake boards; and scuba divers have to hold their scuba diving equipment while riding in a personal watercraft. Some racks exist that provide for lashing of skies, wake boards and the like to the sides of the PWC. These racks extend beyond the sides of the craft where they can create a hazard and broaden the width of the craft. To accommodate the increasing number of uses for personal water crafts a need exists for a device that will conveniently store or house the various accessories such as fishing equipment, camping equipment, hunting equipment, water skies, wake boards, scuba diving equipment, and inner-tubes.

Water skiing, wake boarding, scuba diving and inner tubing are examples of popular water activities that require the use of a boat. Unfortunately, not everyone can afford their own boat to engage in such activities. Since personal watercrafts are more affordable and now have the power, a user can utilize a personal watercraft to engage in water skiing, wake boarding, scuba diving and inner tubing. Due to the lack of storage space on personal watercrafts, users have to hold their water skies, wake boards, or scuba gear in their hands until they reached the designated location for the activity. However, if personal watercrafts were equipped with a multipurpose storage rack for holding and/or storing items, personal watercrafts would be more often utilized for such activities.

Similarly, hunting for water fowl, such as but not limited to duck hunting, was only carried out by using a boat. However, now that personal watercrafts provide more stability, control, maneuverability and power and are more affordable than boats, a personal watercraft can be utilized in hunting activities. The use of a deployable duck blind is securable to the sides and or top of the PWC to allow for hunting from the PWC. Since personal watercrafts of today do not have a multipurpose storage rack for holding and or storing items for such hunting activities, a multipurpose storage rack needs to be developed for personal watercrafts.

Fishing is another activity engaged in from a boat. Due to the added stability and control of personal watercrafts, personal watercraft can now be considered a viable option for a user to engage in fishing. Utilizing a personal watercraft to engage in fishing would be ideal since the size and maneuverability of the personal watercraft would allow the fisherman to access areas that are impossible to reach with fishing boats. However, since personal water craft of today do not have a multipurpose storage rack for holding and/or storing items such as a fishing pole, tackle box, and a trolling motor for use in fishing, a multipurpose storage rack needs to be developed for personal water crafts.

With the ability to engage in additional activities, there exists a substantial need in the art for an improved personal watercraft that can store the equipment necessary to engage in various activities. By utilizing a personal water craft that is equipped with a multipurpose storage rack, the user can engage in any of a number of activities with the convenience of transporting with ease related gear, equipment and the like.

Personal watercrafts of today do not have the capacity to store anything on the exterior of the watercraft. (i.e. fish equipment, hunting equipment, camping equipment, wake boarding equipment, water skiing equipment, inner-tubing equipment, scuba diving equipment and the like. As such, this invention seeks to address those needs.

BRIEF SUMMARY OF THE INVENTION

It is an object of the present invention to increase the capacity of a personal water craft to carry and store items such as fishing equipment, hunting equipment, camping equipment, water skies, wake boards, scuba diving equipment, inner-tubes and other articles or items.

It is another object of the present invention to have a multipurpose storage rack that will not require a user to open the hood of the watercraft in order to access various articles or items.

It is another object of the present invention to have a multipurpose storage rack that will not prohibit a user from opening the hood to accessing items contained in the hood.

It is another object of the present invention to utilize a personal water craft having a multipurpose storage rack for storing items such as fishing equipment, hunting equipment, camping equipment, water skies, wake boards, scuba diving equipment, and inner-tubes as well as other articles or items on the exterior of the vehicle.

It is another object of this invention to provide a personal watercraft that has a multipurpose storage rack, which provides a way to store items on the surface of the personal watercraft or on the front section of the surface of the personal watercraft.

It is another object of the present invention to provide a personal water craft that has a multipurpose storage rack that is simple to construct easy to install, economical to manufacture, and reliable in operation and use.

It is another object of the present invention to provide a method for using a personal water craft having a multipurpose storage rack for storing items such as fishing equipment, camping equipment, water skies, wake boards, scuba diving equipment, and inner-tube as well as other articles or items.

It is another object of this invention to provide a multipurpose storage rack that has a means to temporarily or permanently attach or connect the multipurpose rack onto the personal watercraft.

It is another object of this invention to utilize suitable sealing material to prevent water from seeping into the personal watercraft.

It is another object of this invention to provide a multipurpose storage rack that has a means to temporarily connect the multipurpose storage rack to the personal watercraft. When the multipurpose storage rack is detached from the personal watercraft, it is an object of this invention to utilize plugs if necessary to prevent water from seeping into the personal watercraft. Quick attachment and releasing mechanisms are incorporated to allow for fast and easy installation and removal of the multipurpose rack.

It is another object of this invention to utilize a personal watercraft for fishing.

It is another object of this invention to utilize a personal watercraft that is equipped with a "trolling motor" for fishing.

It is another object of this invention to utilize a personal watercraft that has for attaching a trolling motor to it.

It is another object of this invention to provide a method of using a personal watercraft for fishing.

It is another object of this invention to provide a method for fishing using a personal watercraft that has a trolling motor.

In addition to the above objects, various other objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

Figure 1:
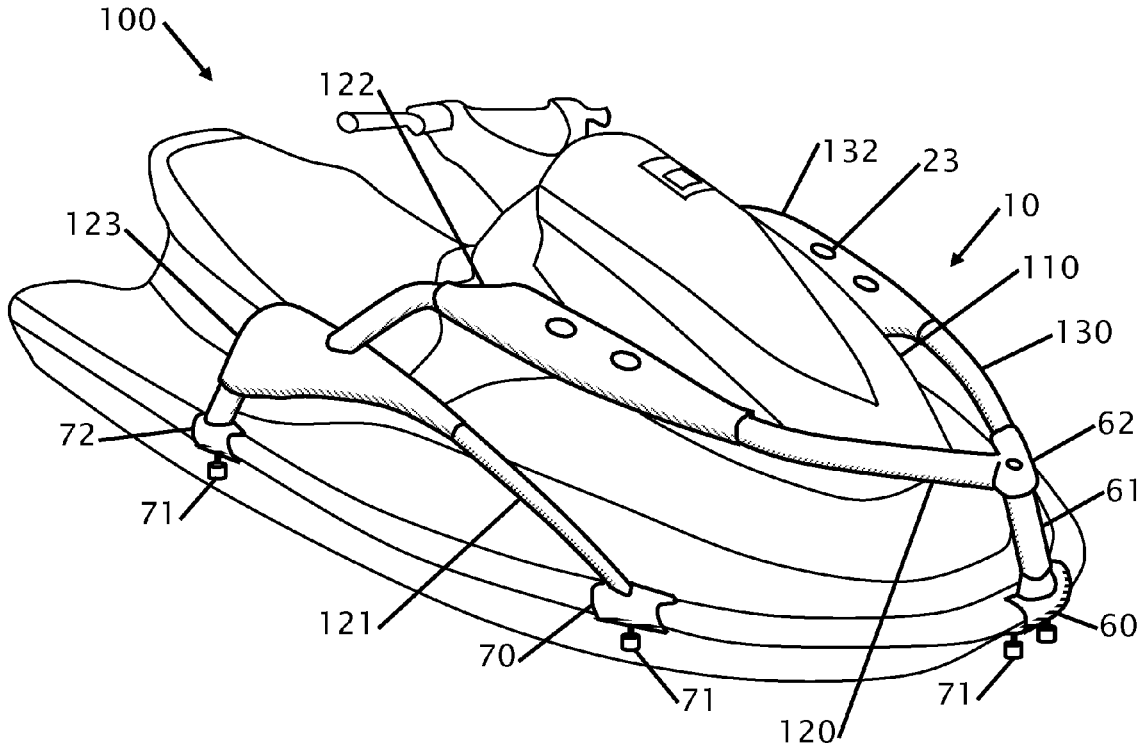
FIG. 1 is a front perspective view of the multipurpose storage rack attached to a personal watercraft.

Other features and advantages of the invention will become apparent from the following detailed descriptions, taken in conjunction with the accompanying drawings, which illustrate, by way of example, various features of the invention.

DETAILED DESCRIPTION OF THE INVENTION

The following detailed descriptions and accompanying drawings are provided for the purpose of illustrating and describing presently preferred embodiments of the present invention and are not intended to limit the scope of the invention in anyway. It will be understood that various changes in the details, materials, arrangements of parts or operational conditions which have been herein described and illustrated in order to explain the nature of the invention may be made by those skilled in the art within the principles and scope of this invention.

Turning now to the drawings as seen in FIGS. 1-4, 7 and 8, the multipurpose storage rack of the present invention is specifically for use with a personal watercraft.

Referring to the drawings more particularly by reference numbers, FIGS. 1 through 4, 7 and 8 show a personal water craft 100 having a front or nose section 101, middle section 102, and a rear section 103 and a multi-purpose storage rack 10 of the present invention, which is attached to the front section 101 of a personal water craft 100.

The storage rack 10 is configured to be removably secured on a personal watercraft 100. FIGS. 1-4 shows how the storage rack 10 is placed onto and secured to the personal watercraft 100. A typical personal water transportation craft is for accommodating at least one rider. The frame having at least two arms 120 and 130 that are pivotably attached through a pivot joint 62 onto a nose tube 61 that is essentially central securing nose hardware 60 that secures to the front nose or lip 101 of the personal watercraft 100.

The central securing nose hardware 60 having a clamping means including clamps or thumbscrews 71 for securing said essentially central securing hardware 60 onto a nose 101 of a personal water transportation craft 100.

First and second arms 120 and 130 are pivotably connected through a pivoting joint 62. From FIG. 2 the arms are shown closed for storage. The arms are moved out 11 for placement onto the personal watercraft. FIG. 4 shows the storage rack 10 being brought over and onto the personal watercraft where it is lowered onto the craft. From FIG. 3 the side arms of the storage rack 10 are brought in 12 such that the forward side clamps 70 and the rearward side clamps grips onto the annular lip that extends around the personal watercraft to reduce water from splashing over the sides of the personal watercraft 10.

Each of said arms 120 and 130 have separate clamping hardware 70 and 72 for clamping onto the sides of the personal watercraft with a three point (nose and two sides) on each side for securing said arms on sides of said personal water transportation craft.

The side clamping hardware 70 and 72 each use threaded hardware 71 or similar clamping means to temporally or permanently secure the storage rack 10 onto the personal watercraft. The securing hardware is expandable to accommodate different widths of personal water transportation crafts. Each of said at least two pivotably attached arms has securing hardware allows temporal clamping of said apparatus onto opposing sides of said personal water craft using two separate clamping positions on each side of said personal watercraft as a means for the function of to provide providing at least a three point clamping structure on the front and sides of said personal watercraft 10.

Figure 8:
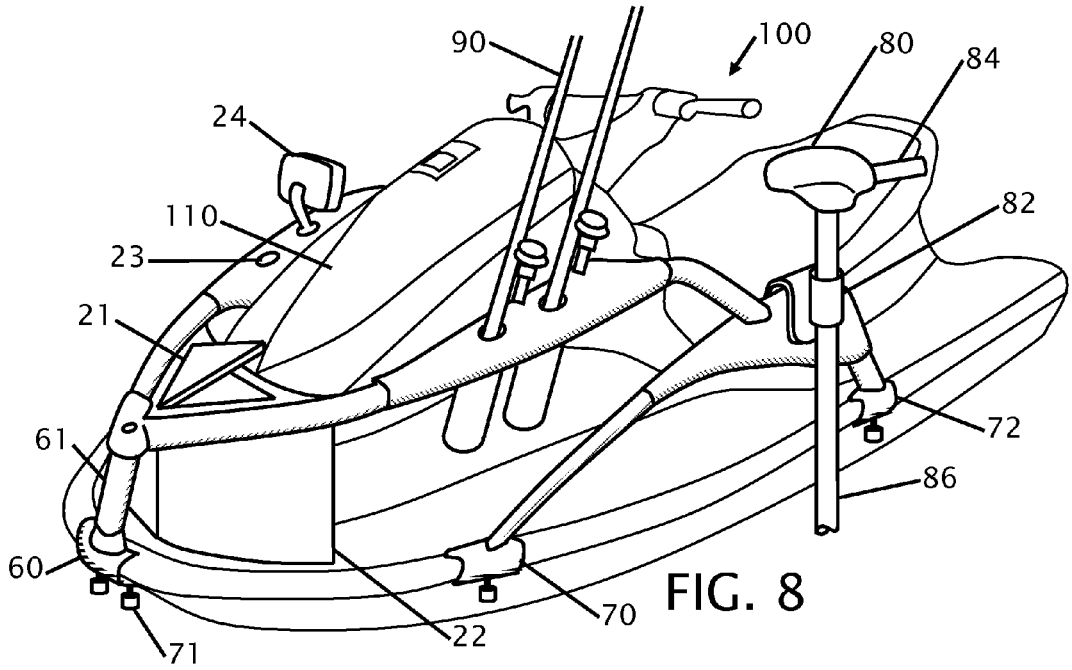
FIG. 8 is a front side view of a personal watercraft showing a multipurpose storage rack configured for fishing with a trolling motor and fishing poles.

The first 120 and second 130 side arm members have holders 122 and 132 that connect into first and second side arm tubes 121 and 131 respectively. Covers 123 and 133 cover the connection of the side tubes and provide a structure for mounting a trolling motor 80 as shown in FIG. 8. The clamping hardware 60, 70 and 72 is configured as a means to grip a lip of said personal watercraft from both above and below said lip.

Figure 5:
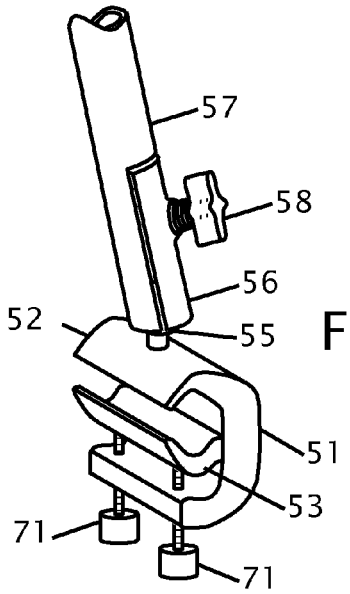
FIG. 5 shows a first embodiment of a clamping mechanism configured to clamp on the annular lip of a personal watercraft.
Figure 6:
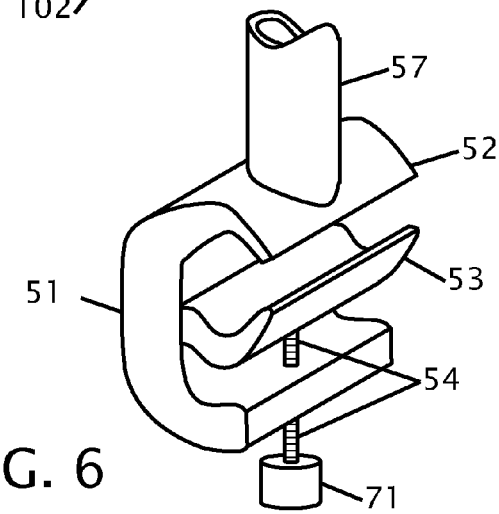
FIG. 6 shows a second embodiment of a clamping mechanism configured to clamp on the annular lip of a personal watercraft.

In FIGS. 5 and 6 two different configurations of clamps are shown and described. In both of these figures a bracket 51 wraps around the annular lip of the personal watercraft 100. The annular lip is clamped between the upper lip 52 and the lower lip 53. A thumbscrew 71 turns a screw 54 or similar mechanism that urges the lower lip 53 upward to clap onto the annular lip of the personal watercraft 10. In FIG. 5 two parallel sets of screw clamps are used and in FIG. 6 only one screw is used. In FIG. 6 the bracket 51 is welded to the tube 57 whereas in FIG. 5 the tube 57 connects to the bracket 51 with a ball socket 55 on a ball clamp 56. A hand screw 58 grips onto the ball 55. The ball joint allows the bracket 51 to pivot on the tube 57 as a means to function as a pivot to accommodate different angles of interface between the storage rack 10 and different size and shapes personal watercrafts 100.

Figure 7:
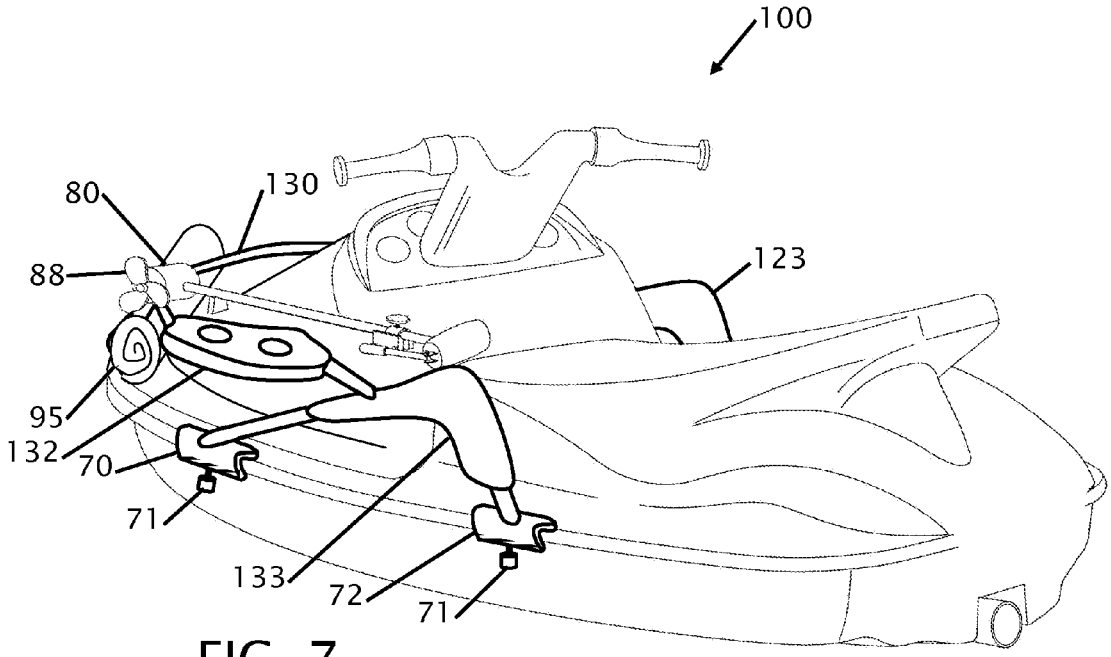
FIG. 7 is a rear view of the multipurpose storage rack attached to a personal watercraft.

In the preferred embodiment of the rack as shown in FIGS. 7 and 8, the multi-purpose storage rack 10 is designed to allow a user to access (open and close) the hood 110 of the personal watercraft 100 for storing items.

One or more removable storage pockets 22 are contemplated where either the frame is designed for use with a standard cooler, ice chest, bucket or the cooler is designed for the rack. In the embodiment shown in FIGS. 7 and 8 the storage pocket has a lid 21 to enclose, insulate, isolate, or protect the items placed within the pocket(s) 23 Items that are contemplated include but are not limited to glasses, food, cups, plates, eating utensils water soda and or a rear view mirror 24. Additional storage pockets or containers are contemplated for fishing gear such as bait, hooks, line and sinkers.

Figure 2:
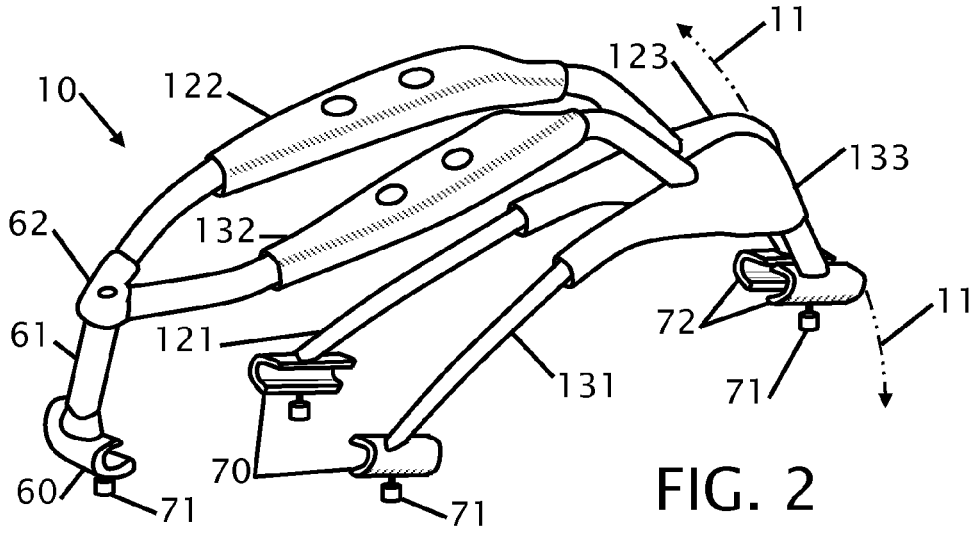
FIG. 2 shows the storage rack in a closed position.
Figure 3:
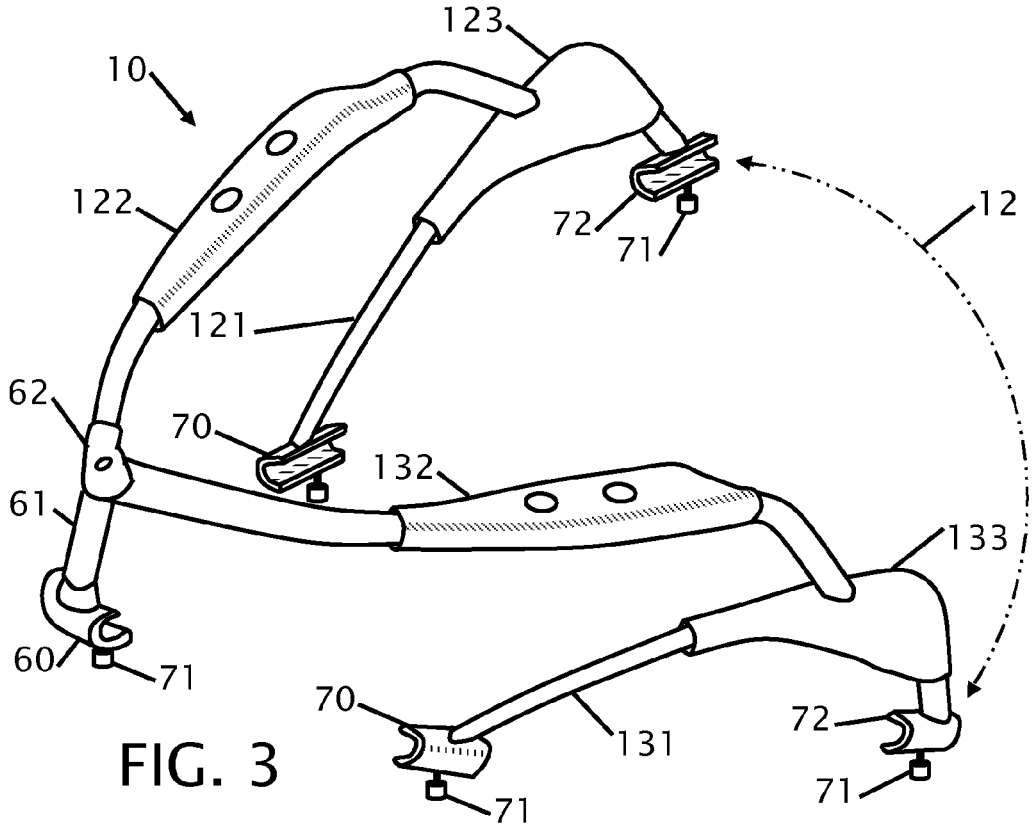
FIG. 3 shows the storage rack is an opened position.
Figure 4:
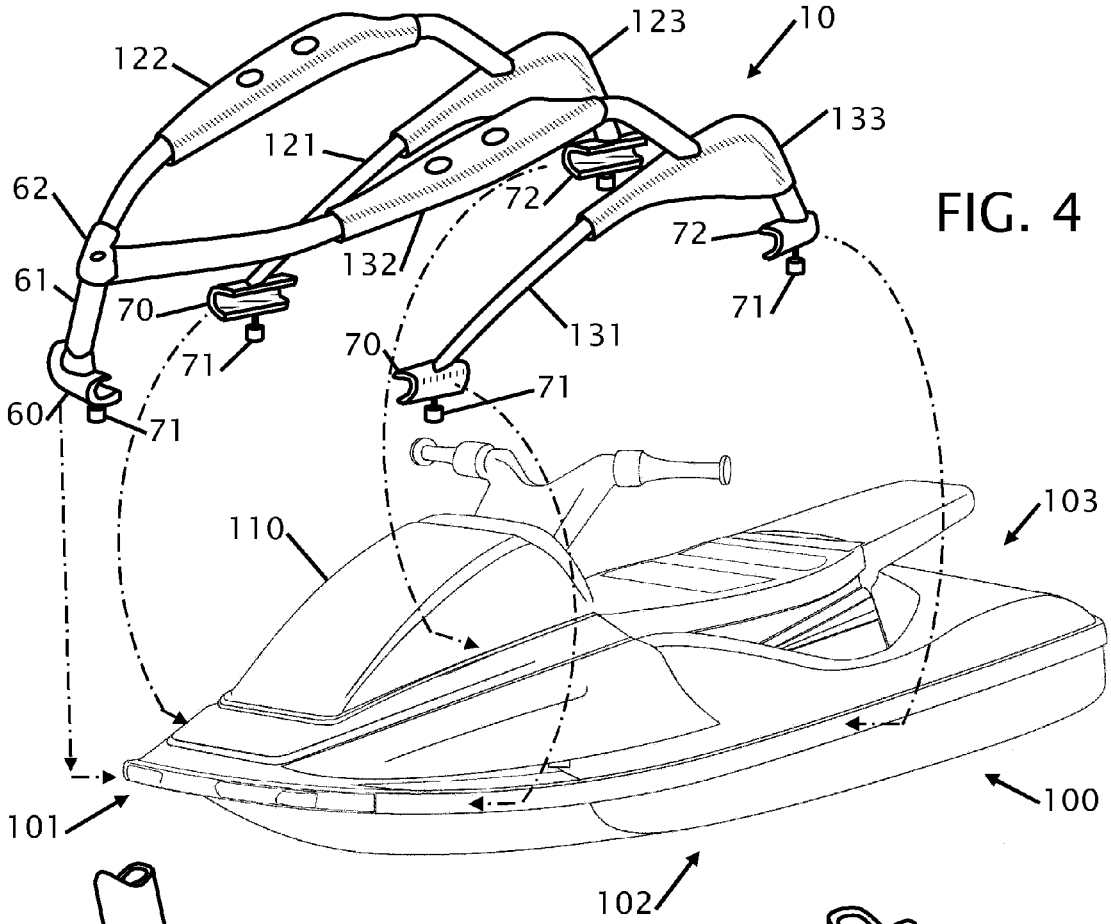
FIG. 4 shows the storage rack being placed onto a personal watercraft.

Storing items such as fishing equipment, camping equipment, hunting equipment, water skies, wake boards, scuba diving equipment, inner-tubes and other articles or items is accomplished by lashing or securing the articles or items to the upper crossed members 35, as seen in FIGS. 2 and 3. Other contemplated items include but are not limited to cooking equipment, cooking supplies, knifes, guns, fuel, and ammunition.

FIG. 8 shows that the trolling motor 80 is attached to said personal water craft 100 by means of bolts 50 or other suitable means, which connect said trolling motor 80 to said a connection cover 133 or 123.

Due to the added stability of personal watercrafts, a person can utilize a personal watercraft 100 for fishing as seen in FIGS. 7 and 8. The figure also shows that a person can operate a trolling motor 80 while fishing using a fishing pole 90 on a personal watercraft 100. The trolling motor 80 is equipped with a mount 82 to securely connect to the multipurpose storage rack 10. The trolling motor 80 also has a handle 84 that is positioned to allow the person on the personal watercraft 100 to control the direction and speed of the trolling motor. The trolling motor also has a shaft 86 that connects to the handle 84 and to the propeller 88, which is positioned in the water to allow the person to the control direction. The figure further shows that the multipurpose storage rack can have a sleeping bag 95 lashed to it. A shade or cover can be secured to the rack. It is contemplated that the cover is securable to the rack and or deployable from the rack where it is movable from above the storage rack to above the rider for protection from the sun. The shade or cover can be expandable down and around the personal watercraft to provide for a duck blind or mosquito netting.

A method of using a personal water craft for carrying items comprising the steps: providing a personal water craft having a hull, a deck disposed on said hull, a hood movably connected to the forward portion of said deck, an engine positioned within the hull, a seat mounted atop said deck for accommodating at least one rider, when seated; and a multi-purpose rack having a surface for carrying one or more items, wherein said multi-purpose rack is disposed forward of said seat and wherein at least a portion of said multi-purpose rack extends outwardly from said hood and said multi-purpose rack is bolted to at least a portion of said deck; wherein said rider positions one or more items on said surface of said multi-purpose rack, said rider then lashes down said items to prevent said items from falling off said personal water craft when said water craft is being utilized in the water.

A method of using a personal water craft to fish comprising the steps: providing a personal water craft having a hull, a deck disposed on said hull, a hood movably connected to the forward portion of said deck, an engine positioned within the hull, a seat mounted atop said deck for accommodating at least one rider, when seated; and a multi-purpose rack which is disposed forwardly of said seat and extends outwardly from said hood of said water craft; said multi-purpose rack is bolted to at least a portion of said deck of said personal water craft; said multi-purpose rack has a surface for carrying one or more items; and a cord for lashing down fishing equipment to said multi-purpose rack to prevent said fishing equipment from falling off said personal water craft when said water craft leaves the shore and is being utilized in the water; wherein said rider reaches the desired location for fishing, said rider un-lashes said fishing equipment from said multi-purpose rack and takes out a fishing pool to fish from said personal water craft; wherein said rider is done fishing, said rider re-lashes said fishing pool and said fishing equipment to said multi-purpose rack, then said rider can return the personal water craft to the shore.

While the description above refers to particular embodiments of the present invention, it will be understood that many modifications may be made without departing from the spirit thereof. The presently disclosed embodiments are therefore to be considered in all respects as illustrative and not restrictive.

The invention claimed is:

1. An apparatus for use on a personal water transportation craft for accommodating at least one rider and comprising:

a personal water transportation craft;

a frame having at least two arms pivotably attached to an essentially central securing nose hardware;

said essentially central securing nose hardware having a temporal clamping means for securing said essentially central securing hardware onto a nose by temporally gripping a lip of a said personal water transportation craft from both above and below said lip;

each of said arms having separate clamping hardware for securing said arms on each outer sides of said personal water transportation craft;

said at least two pivotably attached arms pivot on said central securing nose hardware to accommodate different widths of personal water transportation crafts, and wherein each of said at least two pivotably attached arms has securing hardware that allows temporal clamping of said apparatus onto opposing outer horizontal lip sides of said personal water craft using two separate clamping positions on each side of said personal water craft as a means for the function of providing at least a three point temporal rigid clamping structure that pivot from said securing nose hardware onto both outer sides of said personal water craft.

2. The apparatus, according to claim 1, wherein said apparatus further includes securing means for a trolling motor, fishing equipment, which is lashed or secured to said frame.

3. The apparatus, according to claim 1 that further includes at least one removable storage pocket.

4. The apparatus, according to claim 2, wherein said removable storage pocket is closable.

5. The apparatus, according to claim 1, wherein said apparatus further includes securing means for securing a cooler, ice chest, bucket, glasses, cups, plates, eating utensils, umbrella, soda, water which is lashed to said apparatus or stored within or on said frame.

6. The apparatus, according to claim 1, wherein said apparatus further includes securing means for securing a trolling motor, fishing poles, fishing gear, bait, hooks, line, sinkers which is lashed to said apparatus or stored within said frame.

7. The apparatus, according to claim 1, wherein said apparatus further includes securing means for securing cooking equipment, cooking supplies, knife, gun, fuel, ammunition which is lashed to said apparatus or stored within or on said frame.

8. The apparatus, according to claim 1, wherein said frame further includes expandable components to alter to front and or sides of the rack to accommodate personal transportation crafts or vehicles of different sizes.

* * * * *